United States Patent [19]

Hughes

[11] 4,396,862

[45] Aug. 2, 1983

[54] COLOR PICTURE TUBE WITH MEANS FOR AFFECTING MAGNETIC DEFLECTION FIELDS IN ELECTRON GUN AREA

[75] Inventor: Richard H. Hughes, Lancaster, Pa.

[73] Assignee: RCA Corporation, New York, N.Y.

[21] Appl. No.: 901,820

[22] Filed: May 1, 1978

[51] Int. Cl.[3] ..... H01J 29/50

[52] U.S. Cl. ..... 313/413

[58] Field of Search ..... 313/413, 412, 414; 5/451

[56] References Cited

U.S. PATENT DOCUMENTS

| | | | |
|---|---|---|---|
| 3,164,737 | 1/1965 | Messineo et al. . | |
| 3,196,305 | 7/1965 | Barkow | 313/413 |
| 3,534,208 | 10/1970 | Krackhardt et al. | 313/412 |
| 3,548,249 | 12/1970 | Yoshida et al. | 315/13 |
| 3,594,600 | 7/1971 | Murata et al. . | |
| 3,772,554 | 11/1973 | Hughes . | |
| 3,800,176 | 3/1974 | Gross et al. | 313/412 X |
| 3,840,765 | 10/1974 | Takenaka et al. . | |
| 3,860,850 | 1/1975 | Takenaka et al. | 313/428 |
| 3,866,080 | 2/1975 | Barkow | 313/412 |
| 3,873,879 | 3/1975 | Hughes | 315/13 |
| 4,057,747 | 11/1977 | Hamano | 313/413 |
| 4,086,513 | 4/1978 | Evans, Jr. | 313/414 |
| 4,142,131 | 2/1979 | Ando et al. | 313/412 X |

FOREIGN PATENT DOCUMENTS

| | | | |
|---|---|---|---|
| 2215723 | 2/1977 | Fed. Rep. of Germany . | |
| 53-134622 | 10/1978 | Japan . | |
| 1397804 | 6/1975 | United Kingdom | 313/412 |
| 364984 | 4/1973 | U.S.S.R. . | |

OTHER PUBLICATIONS

"New Self-Convergence Yoke and Picture Tube System with 110° In-line Feature", by K. Ando et al., *IEEE Transactions on Consumer Electronics,* vol. CE-23, No. 3, Aug. 1977, pp. 375-382.

Ref. "E" Has Been Cited by Applicant in the Amendment filed Feb. 1, 1979.

*Primary Examiner*—Palmer C. Demeo

*Attorney, Agent, or Firm*—Eugene M. Whitacre; Glenn H. Bruestle; Dennis H. Irlbeck

[57] ABSTRACT

A color picture tube has an inline electron gun for generating and directing three electron beams, comprising a center beam and two outer beams, along coplanar paths toward a screen of said tube. The three beams pass through a deflection zone adapted to have vertical and horizontal magnetic deflection fields established therein. The improvement comprises the inclusion of first means for weakening the effect of a portion of the horizontal magnetic deflection field on the center electron beam. Such means include elongated magnetic members located between the outer beams and the center beam with the direction of elongation being perpendicular to the plane of the electron beam paths. Also included are second means for weakening the effect of portions of both deflection fields on the two outer beams. The second means includes magnetic shield members completely surrounding each of the outer beam paths.

5 Claims, 9 Drawing Figures

PRIOR ART
Fig.3.
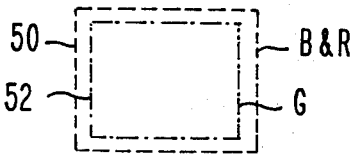
Fig.6.
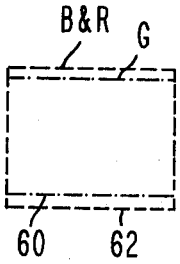
Fig.6A.
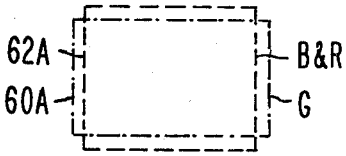
PRIOR ART
Fig.4.
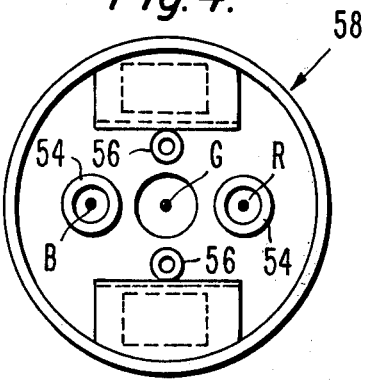
Fig.7.
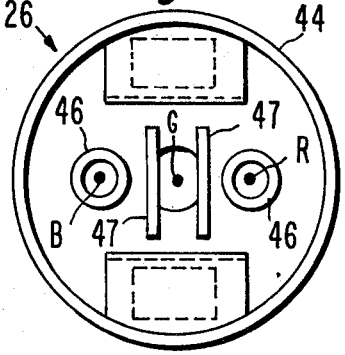
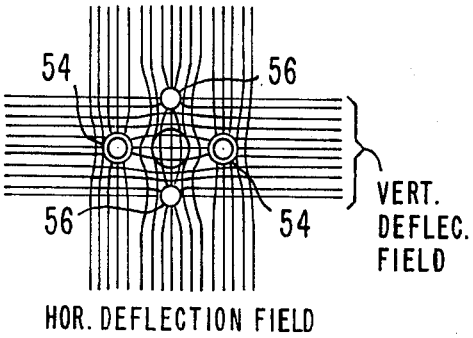
Fig.5.
PRIOR ART
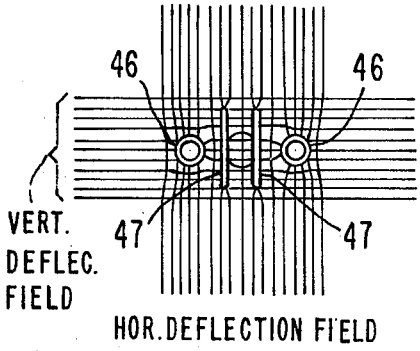
Fig.8.

COLOR PICTURE TUBE WITH MEANS FOR AFFECTING MAGNETIC DEFLECTION FIELDS IN ELECTRON GUN AREA

BACKGROUND OF THE INVENTION

The present invention relates to a color picture tube having an improved inline gun, and particularly to an improvement in the electron gun for obtaining equal raster sizes (also called coma correction) within the tube.

An inline electron gun is one designed to generate or initiate preferably three electron beams in a common plane and direct those beams along convergent paths in that plane to a point or small area of convergence near the tube screen.

A problem that exists in a color picture tube having an inline gun is a coma distortion wherein the sizes of the rasters scanned on the screen by an external magnetic deflection yoke are different because of the eccentricity of the two outer beams with respect to the center of the yoke. Messineo et al. U.S. Pat. No. 3,164,737 issued Jan. 5, 1965, teaches that a similar coma distortion caused by using different beam velocities can be corrected by use of a magnetic shield around the path of one or more beams in a three gun assembly. Barkow U.S. Pat. No. 3,196,305, issued July 20, 1965, teaches the use of magnetic enhancers adjacent to the path of one or more beams in a delta gun, for the same purpose. Krackhardt et al. U.S. Pat. No. 3,534,208, issued Oct. 13, 1970, teaches the use of a magnetic shield around the middle one of three inline beams for coma correction. Yoshida et al. U.S. Pat. No. 3,548,249, issued Dec. 15, 1970, teaches the use of C-shaped elements positioned between the center and outer beams to enhance the effect of the vertical deflection field on the center beam. Murata et al. U.S. Pat. No. 3,594,600, issued July 20, 1971, teaches the use of C-shaped shields around the outer beams with the open sides of the members facing each other. These shields appear to shunt the vertical deflection field around all three beams. Takenaka et al. U.S. Pat. No. 3,860,850, issued Jan. 14, 1975, teaches the use of V-shaped enhancement members located above and below three inline beams and the use of C-shaped shields around the two outer beams. Hughes U.S. Pat. No. 3,873,879, issued Mar. 25, 1975, teaches the use of small disc-shaped enhancement elements above and below the center beam and ring shaped shunts around the two outer beams.

The inventions of all of the foregoing patents solve different raster correction problems. For example, in the Takenaka et al. patent the two V-shaped members and the two C-shaped members apparently correct for a raster pattern variation wherein the center beam has greater vertical deflection but lesser horizontal deflection than do the outer beams. The correction employed therefore decreases both the vertical and horizontal deflection of the outer beams, decreases the vertical deflection of the center beam and increases the horizontal deflection of the center beam. The four coma correction members of the gun disclosed in the Hughes patent correct for a raster pattern wherein the center beam has less deflection in both the vertical and horizontal directions than do the outer beams. This correction is made by decreasing both the vertical and horizontal deflection of the outer beams and increasing both the vertical and horizontal deflection of the center beam.

Another raster pattern problem has occurred in recently developed inline tubes utilizing a yoke having toroidal vertical deflection windings and saddle horizontal deflection windings which cannot be solved by any of the foregoing mentioned inline tube type coma correction arrangements. In this pattern, the central beam has lesser vertical deflection but equal or greater horizontal deflection than do the outer beams. The following described invention provides coma correction for such raster patterns by the use of a novel combination of correction members.

SUMMARY OF THE INVENTION

An inline electron gun includes first means for weakening the effect of a portion of the horizontal magnetic deflection field on the center electron beam and second means for weakening the effect of portions of both deflection fields on the two outer beams.

BRIEF DESCRIPTION OF THE DRAWINGS

FIG. 3 illustrates electron beam raster patterns which are corrected by a prior art use of shunts and enhancers in an inline electron gun.

FIG. 4 is a plan view of the output end of a prior art electron gun wherein the gun includes shunts and enhancers for correcting the raster pattern shown in FIG. 3.

FIG. 5 illustrates the distortion of a portion of the vertical and horizontal fields caused by the shunts and enhancers of the prior art gun of FIG. 4.

FIGS. 6 and 6A illustrate electron beam raster patterns which are corrected by the novel structures disclosed herein.

FIG. 7 is a plan view of the electron gun of FIG. 2 taken at line 7—7 illustrating one embodiment of members for correcting the raster patterns of FIG. 6.

FIG. 8 illustrates the distortion of a portion of the vertical fields caused by the raster correction members of the gun of FIGS. 2 and 7.

DETAILED DESCRIPTION OF THE PREFERRED EMBODIMENT

Figure 1:
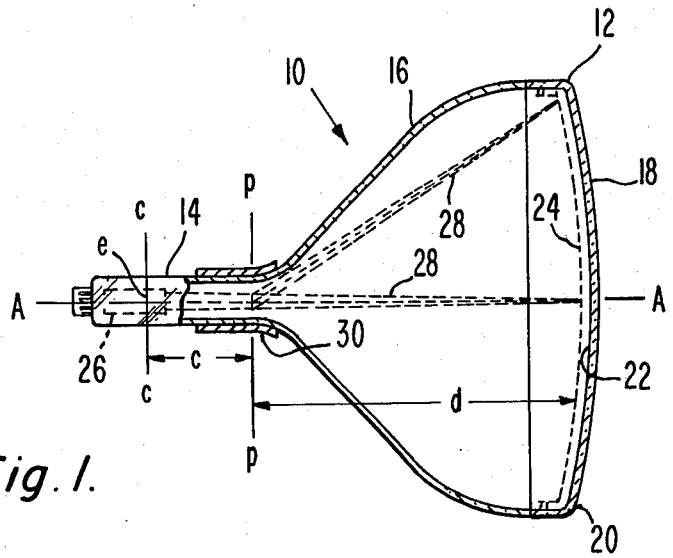
FIG. 1 is a plan view, partly in axial section of a shadow mask color picture tube in which one embodiment of the present invention is incorporated.

FIG. 1 is a plan view of a rectangular color picture tube 10 having a glass envelope comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A mosaic three-color phosphor screen 22 is carried by the inner surface of the faceplate 18. The screen is preferably a line screen with the phosphor lines extending substantially parallel to the minor axis Y—Y of the tube (normal to the plane of FIG. 1). A multi-apertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube 10 of FIG. 1 is designed to be used with an external magnetic deflection yoke, such as the yoke 30 schematically shown surrounding the neck 14 and funnel 16 in the neighborhood of their junction, for subjecting the three beams 28 to vertical and horizontal magnetic flux, to scan the beams horizontally and vertically, respectively, in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of the gun 26. For simplicity, the actual curvature of the deflected beam paths in the deflection zone is not shown in FIG. 1.

Figure 2:
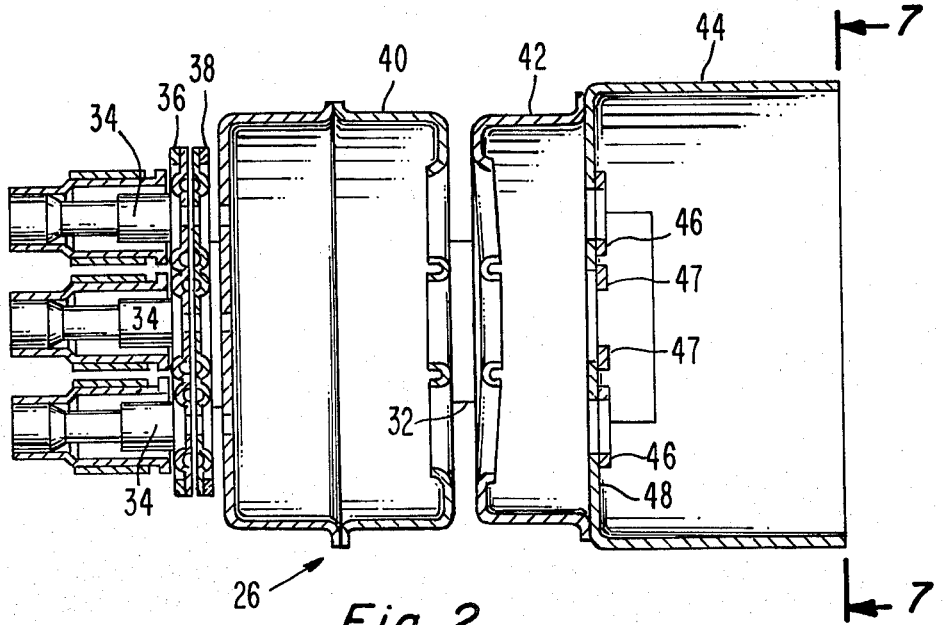
FIG. 2 is an axial section view of the electron gun shown in dashed lines in FIG. 1.

The details of the gun 26 are shown in FIG. 2. The gun comprises two glass support rods 32 on which the various electrodes are mounted. These electrodes include three equally spaced coplanar cathodes 34 (one for each beam), a control grid electrode 36, a screen grid electrode 38, a first accelerating and focusing electrode 40, a second accelerating and focusing electrode 42, and an electrical shield cup 44, spaced along the glass rods 32 in the order named. Four raster correction members 46 and 47 are located on the back wall 48 of the shield cup 44. Two of these members 46 are annular and surround the paths of the two outer beams and two of the members 47 are elongated bars and are located between the outer beam paths and the center beam path. The shape, size, position and function of these members 46 and 47 will be discussed in greater detail later in the present description.

Further detail of an electron gun similar to gun 26 of FIG. 2 is contained in U.S. Pat. No. 3,772,554, issued to R. H. Hughes on Nov. 13, 1973. This patent is hereby incorporated by reference for the purpose of including such detail.

A pattern of rasters corrected by a prior art device is shown in FIG. 3. The outer dashed line 50 (also designated B and R) indicates the raster patterns for the two outer beams which in this case are the blue and red beams. The inner pattern of alternate dashes and dots 52 (also designated G) is the raster pattern for the center or green beam. As taught in Hughes U.S. Pat. No. 3,873,879, cited above, the raster patterns of FIG. 3 are corrected by the arrangement of shunts 54 and enhancers 56 shown in FIG. 4. In this prior art gun embodiment 58, the shunts 54 are small washer-shaped elements that closely surround the two outer beams, B and R. The two enhancers 56 are small washers or discs located directly above and below the center beam, G. The shunts 54 and enhancers 56 distort portions of the two deflection fields as shown in FIG. 5 to provide enhanced vertical and horizontal deflection of the center beam and decreased vertical and horizontal deflection of the two outer beams.

FIGS. 6 and 6A illustrate the two recently encountered raster patterns described above. The center beam rasters, shown by alternate dash and dot lines 60 and 60A (also labeled G) have less vertical deflection be equal (as shown in FIG. 6) or greater (as shown in FIG. 6A) horizontal deflection than do the two outer beam rasters shown by the dashed lines 62 and 62A (also labeled B & R), respectively.

A front view of the gun 26 having novel raster correction members 46 and 47 is shown in FIG. 7. These members 46 and 47 are constructed of a high magnetic permeability material such as an alloy of 52-percent nickel and 48-percent iron known as "52 metal".

The first raster correction members 46 are two washer-shaped shunts that completely surround the two outer beam paths, designated B and R. These members 46 are similar to the shunts 54 of the prior art gun 58 shown in FIG. 4. The members 46 provide means for completely bypassing portions of the vertical and horizontal deflection fields from the two outer beams, as shown in FIG. 8, and thereby weaken the effect of these fields.

The second raster correction members 47 are two rod-shaped or rail-shaped elements that are located between the outer and center beam paths. The members 47 are parallel to each other and oriented with their elongated longitudinal dimension perpendicular to the plane containing the three electron beam paths. Since the members 47 are positioned close to the central beam, they provide means to distort the vertically extending horizontal deflection field so as to weaken the field's effect on the center beam, as shown in FIG. 8.

In the prior art embodiment of FIG. 4, the shunts 54 have an effect on the center beam. This effect is to concentrate some of the horizontally extending vertical deflection field at the center beam path. Such concentration increases the vertical dimension of the center beam raster. However, with the use of the elongated members 47 combined with the shunt members 46, the shunt members have no effect on the center beam raster since the elongated members have a tendency to spread the vertical field back to their original unperturbed configuration. Such spreading is contrary to what might be expected from a review of the function of the prior art C-shaped enhancers previously discussed.

The net effect, therefore, of the combined use of the raster correction members 46 and 47 is to reduce both the vertical and horizontal dimensions of the outer beam rasters and to decrease the horizontal dimension of the center beam raster so that the rasters of all three beams are coincident. The reduction of the horizontal dimension of the center beam raster must be equal to or greater than the reduction of the horizontal dimension of the outer beam rasters to obtain this coincidence, given the original raster patterns of FIGS. 6 and 6A.

Specific adjustments to obtain relatively exact coincidence of raster patterns can be made by varying the thickness of the correction members 46 and 47. For example, increasing the thickness of the outer beam correction members 46 will reduce the outer beam rasters relative to the center beam raster. Conversely, increasing the thickness of the center beam correction members 47 will decrease the horizontal deflection of the center beam raster as compared to the outer beam rasters. Therefore, minor corrections in raster patterns can be made by the proper increase and/or decrease of thickness of the correction members 46 and 47.

Typical dimensions for a 25V110° deflection type tube incorporating the gun of FIGS. 2 and 7 are as follows.

| | |
|---|---|
| Spacing between center and outer beam paths | 6.60 mm |
| Thickness of members 46 and 47 | 0.25 mm |
| Outer diameter of members 46 | 5.08 mm |
| Inner diameter of members 46 | 4.06 mm |
| Length of members 47 | 10.16 mm |
| Width of members 47 | 0.90 mm |

Although the present invention has been described with respect to a tube having a unitized type inline gun with small spacings between beam paths, it should be understood that the invention is also applicable to other tubes having different types of inline electron guns such as those having larger beam path spacings and/or nonunitized construction.

What I claim is:

1. In a color picture tube having an inline electron gun for generating and directing three electron beams, comprising a center beam and two outer beams, along coplanar paths toward a screen of said tube, wherein the beams pass through a deflection zone adapted to have vertical and horizontal magnetic deflection fields established therein, the improvement comprising:

first means for weakening the effect of portions of both the horizontal and vertical deflection fields on the two outer electron beams, and second means for weakening the effect of a portion of the horizontal magnetic deflection field on the center electron beam, and maintaining an undisturbed effect of the vertical magnetic deflection field on the center electron beam.

2. The tube as defined in claim 1 wherein said first means are annular members completely surrounding each outer beam path.

3. The tube as defined in claim 1 wherein said second means are parallel elongated bars located between the outer beam paths and the center beam path.

4. In a color picture tube having an inline electron gun for generating and directing three electron beams comprising a center beam and two outer beams toward a screen of said tube, said tube including a deflection zone through which said electron beams pass, said deflection zone including means for deflecting said beams into essentially rectangular rasters on the screen, wherein without correction the deflecting means causes the center beam raster to have less vertical height but greater horizontal width than have the rasters of the two outer beams, the improvement comprising, first means on said gun within the deflection zone for reducing the vertical and horizontal dimensions of the outer beam rasters, said first means tending to distort the vertical dimension of the center beam raster, and second means for decreasing the horizontal dimension of the center beam raster more than said first means reduces the horizontal dimension of the outer beam rasters, said second means correcting for the tendency of said first means to distort the vertical dimension of the center beam raster, whereby the net effect on the vertical dimension of the center beam raster caused by the combination of the first and second means is negligible.

5. In a color picture tube including an evacuated envelope comprising a faceplate and a neck connected by a funnel, a mosaic color phosphor screen on the inner surface of said faceplate, a multiapertured color selection electrode spaced from said screen, an inline electron gun mounted in said neck for generating and directing three electron beams comprising a center beam and two outer beams along coplanar paths to said screen, and a deflection zone, located in the vicinity of the junction between said neck and said funnel, wherein said beams are subjected to vertical and horizontal magnetic deflection fields during operation of said tube for scanning said beams horizontally and vertically over said screen, the improvement comprising, means for decreasing the effect of the horizontal magnetic deflection field on said three electron beams, for decreasing the effect of the vertical magnetic deflection field on the two outer beams and for maintaining the effect of the vertical magnetic deflection field on said center beam.

* * * * *